US010426233B2

(12) United States Patent
Numata et al.

(10) Patent No.: US 10,426,233 B2
(45) Date of Patent: Oct. 1, 2019

(54) METHOD FOR MANUFACTURING WATERPROOF FASTENER TAPE

(71) Applicant: YKK Corporation, Tokyo (JP)

(72) Inventors: Yoshie Numata, Toyama (JP); Masahide Ozaki, Toyama (JP); Masanobu Mizuno, Toyama (JP); Toshimasa Konaka, Toyama (JP); Takuya Nagatani, Toyama (JP)

(73) Assignee: YKK Corporation (JP)

( * ) Notice: Subject to any disclaimer, the term of this patent is extended or adjusted under 35 U.S.C. 154(b) by 25 days.

(21) Appl. No.: 15/558,837

(22) PCT Filed: Apr. 3, 2015

(86) PCT No.: PCT/JP2015/060665
§ 371 (c)(1),
(2) Date: Sep. 15, 2017

(87) PCT Pub. No.: WO2016/157536
PCT Pub. Date: Oct. 6, 2016

(65) Prior Publication Data

US 2018/0078007 A1 Mar. 22, 2018

(51) Int. Cl.
*A44B 19/32* (2006.01)
*A44B 19/40* (2006.01)
*A44B 19/42* (2006.01)

(52) U.S. Cl.
CPC ..... *A44B 19/32* (2013.01); *A44B 19/406* (2013.01); *A44B 19/42* (2013.01)

(58) Field of Classification Search
USPC ..... 156/230, 234, 238, 247, 249, 289
See application file for complete search history.

(56) References Cited

U.S. PATENT DOCUMENTS 3,914,827 A * 10/1975 Brown ..... A44B 19/32 24/389
4,112,150 A * 9/1978 Brown ..... A44B 19/32 427/284

(Continued)

FOREIGN PATENT DOCUMENTS

JP 015196/1977 2/1977
JP 54-092843 A 7/1979

(Continued)

OTHER PUBLICATIONS

International Search Report, PCT Patent Application No. PCT/JP2015/060665, dated Jun. 23, 2015.

(Continued)

*Primary Examiner* — Sing P Chan
(74) *Attorney, Agent, or Firm* — Kilpatrick Townsend & Stockton LLP

(57) ABSTRACT

A method for manufacturing a waterproof fastener tape includes the steps of: forming a viscous waterproof layer on a releasable substrate; attaching the viscous waterproof layer formed on the releasable substrate to a fastener tape base fabric, and peeling the releasable substrate off the viscous waterproof layer that has been attached to the fastener tape base fabric; promoting curing of the viscous waterproof layer formed on the fastener tape base fabric to form a reduced-viscosity waterproof layer; and after the promoting of curing of the viscous waterproof layer, covering an exposed surface of the reduced-viscosity waterproof layer formed on the fastener tape base fabric with a releasable cover.

8 Claims, 10 Drawing Sheets

(56) References Cited

U.S. PATENT DOCUMENTS

| | | | | |
|---|---|---|---|---|
| 4,262,569 | A | 4/1981 | Yoshieda et al. | |
| 4,715,926 | A | 12/1987 | Murasaki | |
| 6,105,214 | A * | 8/2000 | Press | A44B 19/32 24/389 |
| 6,998,082 | B2 * | 2/2006 | Yang | A44B 19/36 264/156 |
| 7,195,025 | B2 * | 3/2007 | Choi | E04H 15/32 135/117 |
| 7,293,333 | B2 * | 11/2007 | Stenhall | A44B 19/32 24/389 |
| 7,386,893 | B2 * | 6/2008 | Chang | A41D 3/00 2/87 |
| 7,954,209 | B2 * | 6/2011 | Chen | A44B 19/32 24/389 |
| 9,545,134 | B1 * | 1/2017 | Tan | A44B 19/32 |
| 9,717,310 | B1 * | 8/2017 | Chung | A44B 19/36 |
| 10,080,405 | B2 * | 9/2018 | Cheng | A44B 19/08 |
| 10,144,160 | B2 * | 12/2018 | Cheng | B29C 45/00 |
| 10,264,858 | B2 * | 4/2019 | Chen | A44B 19/32 |
| 2004/0111842 | A1 | 6/2004 | Imai | |
| 2005/0040559 | A1 * | 2/2005 | Yang | A44B 19/36 264/275 |
| 2005/0109382 | A1 * | 5/2005 | Choi | E04H 15/32 135/117 |
| 2006/0010660 | A1 * | 1/2006 | Stenhall | A44B 19/32 24/389 |
| 2006/0101632 | A1 | 5/2006 | Yang | |
| 2006/0162042 | A1 * | 7/2006 | Chang | A41D 3/00 2/96 |
| 2006/0282995 | A1 * | 12/2006 | Liou | A44B 19/32 24/389 |
| 2007/0094852 | A1 | 5/2007 | Wang | |
| 2008/0040837 | A1 * | 2/2008 | King | A41D 13/012 2/227 |
| 2009/0165265 | A1 * | 7/2009 | Chen | A44B 19/32 24/389 |
| 2012/0311828 | A1 * | 12/2012 | Nir | A44B 19/04 24/389 |
| 2013/0180087 | A1 | 7/2013 | Matsuda et al. | |
| 2014/0068899 | A1 * | 3/2014 | Kojima | A44B 19/26 24/399 |
| 2014/0130974 | A1 * | 5/2014 | Chen | A44B 19/32 156/270 |
| 2014/0190614 | A1 * | 7/2014 | Ma | A41H 43/04 156/66 |
| 2014/0359978 | A1 * | 12/2014 | Wang | A44B 19/42 24/389 |
| 2014/0366336 | A1 * | 12/2014 | Chung | A44B 19/32 24/389 |
| 2016/0360840 | A1 * | 12/2016 | Chen | A44B 19/32 |
| 2017/0113384 | A1 * | 4/2017 | Cheng | A44B 19/06 |
| 2017/0208907 | A1 * | 7/2017 | Chung | A44B 19/36 |
| 2017/0266856 | A1 * | 9/2017 | Cheng | B29C 45/00 |
| 2018/0020784 | A1 * | 1/2018 | Cheng | A44B 19/08 24/384 |
| 2018/0055155 | A1 * | 3/2018 | Chen | A44B 19/42 |
| 2019/0030843 | A1 * | 1/2019 | Hsieh | B29D 5/02 |

FOREIGN PATENT DOCUMENTS

| | | | |
|---|---|---|---|
| JP | 62-102934 | A | 5/1987 |
| JP | 2002-525143 | A | 8/2002 |
| JP | 2004-181009 | A | 7/2004 |
| JP | 4312171 | B2 | 5/2009 |
| JP | 3179861 | U | 11/2012 |
| WO | 2012/035653 | A1 | 3/2012 |
| WO | 2014/010019 | A1 | 1/2014 |

OTHER PUBLICATIONS

International Preliminary Report on Patentability, PCT Patent Application No. PCT/JP2015/060665, dated Oct. 12, 2017.

* cited by examiner

METHOD FOR MANUFACTURING WATERPROOF FASTENER TAPE

This application is a national stage application of PCT/JP2015/060665, which is incorporated herein by reference.

TECHNICAL FIELD

The present disclosure mainly relates to a method for manufacturing a waterproof (water-repellent) fastener tape, and a waterproof fastener tape. More particularly, the present disclosure relates to a method for manufacturing a waterproof fastener tape; a waterproof fastener tape; a fastener stringer; a slide fastener; and a laminate.

BACKGROUND ART

Patent Document 1 discloses an environmentally-friendly waterproof fastener tape with a reduced amount of an organic solvent to be used. More particularly, the fastener tape includes a base fabric and a waterproof film affixed onto one surface of the base fabric. The waterproof film has a laminated structure of two layers of a skin layer and an adhesive layer. The skin layer consists of a polyurethane film. The adhesive layer consists of a cured material of an aqueous polyurethane adhesive. Paragraph 0026 of this document describes that an adhesive which will be the adhesive layer includes an aqueous polyurethane, an isocyanate compound, and water.

Paragraph 0045 of Patent Document 1 describes a process of manufacturing the waterproof fastener tape. As a summary, a first layer to be the skin layer is formed on a release film; a second layer to be the adhesive layer is applied onto the first layer; a fastener tape is attached to the second layer using a roller; and finally, curing of each of the first and second layers is accelerated by a heat treatment. Patent Document 2 discloses that, as shown in FIGS. 2 to 4 thereof, a waterproof material 41 is injected into a mold hole 21 of an upper mold 20, and a fastener fabric tape 32 is processed to pass though under the mold hole 21, and at this time, the waterproof material permeates the texture of the fastener fabric tape 32. The lower edge portion of the upper mold 20 is provided with a knife portion 22 so as to remove excessive waterproof material 41.

CITATION LIST

Patent Document 1: WO 2014/010019
Patent Document 2: Japanese Patent No. 4312171

SUMMARY OF INVENTION

Technical Problem

There is a need for further reducing the thickness of the waterproof layer formed on the base fabric of the waterproof fastener tape. Patent Document 1 utilizes a waterproof layer having a double-layered structure in which adhesiveness characteristics is given to one layer and waterproof characteristics is given to the other layer. However, due to the double-layered structure, the total thickness of the waterproof layer tends to be greater.

Solution to Problem

A method for manufacturing a waterproof fastener tape according to one aspect of the present invention may comprise:

forming a viscous waterproof layer on a releasable substrate;

attaching the viscous waterproof layer formed on the releasable substrate to a fastener tape base fabric, and peeling the releasable substrate off the viscous waterproof layer that has been attached to the fastener tape base fabric;

promoting curing of the viscous waterproof layer formed on the fastener tape base fabric to form a reduced-viscosity waterproof layer; and after said promoting of curing of the viscous waterproof layer, covering an exposed surface of the reduced-viscosity waterproof layer formed on the fastener tape base fabric with a releasable cover.

In some embodiments, the method may further comprise winding around a spool a laminate in which the reduced-viscosity waterproof layer and the releasable cover are laminated in this order from the fastener tape base fabric.

In some embodiments, a pattern to be transferred to a surface of the viscous waterproof layer may be formed on a surface of the releasable substrate at a side to be in contact with the viscous waterproof layer.

In some embodiments, a pattern to be transferred to an exposed surface of the reduced-viscosity waterproof layer may be formed on a surface of the releasable cover at a side to be in contact with the reduced-viscosity waterproof layer.

In some embodiments, the viscous waterproof layer may include at least polyurethane, a dispersant, and a curing agent.

In some embodiments, the reduced-viscosity waterproof layer may include at least polyurethane cured with a curing agent.

In some embodiments, said promoting of curing of the viscous waterproof layer may include supplying, to a heater, the fastener tape base fabric provided with the viscous waterproof layer.

In some embodiments, the method may further comprise removing a protruding portion of the viscous waterproof layer which protrudes from the fastener tape base fabric.

A waterproof fastener tape according to another aspect of the present invention may comprise: a fastener tape base fabric; and a waterproof layer formed on the fastener tape base fabric, wherein the waterproof layer is a single layer consisting of a single composition and includes at least polyurethane cured with a curing agent.

In some embodiments, the uppermost limit of thickness of the waterproof layer may be 180 μm or 170 μm or 160 μm or 150 μm or 140 μm or 130 μm or 120 μm or 110 μm.

In some embodiments, the uppermost limit of thickness of the waterproof layer may be 100 μm or 90 μm or 80 μm or 70 μm or 60 μm or 50 μm.

In some embodiments, the waterproof layer may have a surface opposite to the fastener tape base fabric, and a transfer pattern is formed on said surface of the waterproof layer.

A fastener stringer according to a further aspect of the present invention may comprise: the waterproof fastener tape described in the preceding paragraphs; fastener elements attached to the waterproof fastener tape, wherein the fastener tape base fabric has a first surface on which the waterproof layer is formed, and a second surface opposite to the first surface, and wherein the fastener elements are located on the second surface.

A slide fastener according to a further aspect of the present invention may comprise: a pair of left and right fastener stringers, each being equal to the fastener stringer described in the preceding paragraphs; and a fastener slider for opening and closing the fastener stringers.

A laminate according to a further aspect of the present invention may comprise: the waterproof fastener tape according to the preceding paragraphs; and a releasable cover laminated on the fastener tape base fabric via the waterproof layer.

Advantageous Effects of Invention

According to one aspect of the present invention, it may be possible to contribute to further thinning of the waterproof layer formed on the base fabric of the waterproof fastener tape.

BRIEF DESCRIPTION OF DRAWINGS

FIG. 4 is a schematic view showing laminated structures of laminates which appear during steps for manufacturing a waterproof fastener tape according to an embodiment of the present invention.

FIG. 5 is a schematic view showing one surfaces of laminates which appear during steps for manufacturing a waterproof fastener tape according to an embodiment of the present invention.

DESCRIPTION OF EMBODIMENTS

Hereinafter, embodiments of the present invention will be discussed with reference to the drawings. Respective embodiments are not mutually exclusive, and a skilled person could properly combine them without requiring excess descriptions and could understand synergic effects by such combinations. Overlapping descriptions among embodiments will be basically omitted. Referenced drawings are mainly for the purpose of illustrating the invention and may be simplified in an appropriate manner.

Figure 1:
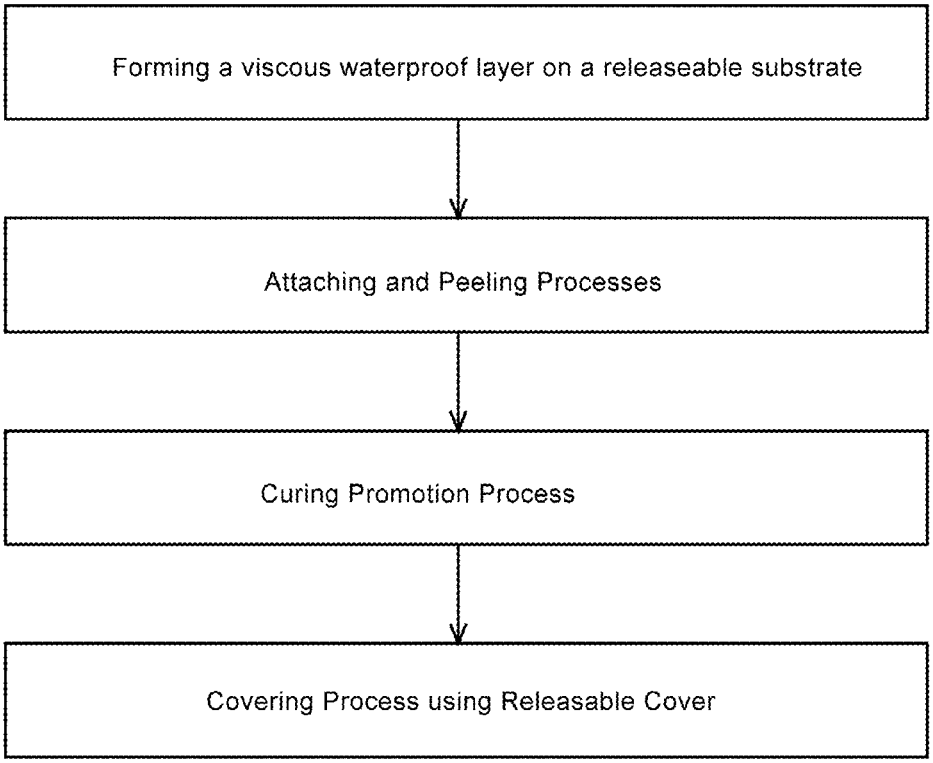
FIG. 1 is a flow chart showing steps for manufacturing a waterproof fastener tape according to an embodiment of the present invention.

Non-limiting exemplary embodiments will be described with reference to FIG. 1. FIG. 1 is a flow chart showing steps for manufacturing a waterproof fastener tape. As can be seen from FIG. 1, the steps for manufacturing the waterproof fastener tape according to an embodiment of the disclosure may include:

- a first step of forming a viscous waterproof layer on a releasable substrate;
- a second step of attaching the viscous waterproof layer formed on the releasable substrate to a fastener tape base fabric, and peeling the releasable substrate off the viscous waterproof layer that has been attached to the fastener tape base fabric;
- a third step of promoting curing of the viscous waterproof layer formed on the fastener tape base fabric to form a reduced-viscosity waterproof layer; and
- a fourth step of, after said promoting of curing of the viscous waterproof layer, covering an exposed surface of the reduced-viscosity waterproof layer formed on the fastener tape base fabric with a releasable cover.

In general, a long period of time may be required for sufficiently curing the waterproof layer. Therefore, in a case where a single viscous waterproof layer is provided onto a fastener tape base fabric and curing of the viscous waterproof layer is promoted, the viscosity of the viscous waterproof layer might possibly act adversely while the fastener tape base fabric is being stored. For example, when a fastener tape base fabric provided with a somewhat cured viscous waterproof layer is wound around a spool and stored, the fastener tape base fabric may possibly be brought into contact with a surface of the viscous waterproof layer, which should be an exposed surface, so that both may be adhered together. According to the above manufacturing method, such a problem may be avoided to be caused while thinning of the waterproof layer is promoted. Furthermore, the use of the releasable substrate and the releasable cover may allow a surface state of the exposed surface of the waterproof layer to be highly controlled. These would be effects that would be never achieved when a fastener tape base fabric is coated with a waterproof layer material in order to form a single layer waterproof layer.

Detailed descriptions will follow hereinafter. In the first step, the viscous waterproof layer is formed on the releasable substrate. The releasable substrate used in the first step may be a commercially-available release paper or release film. The release paper may have a release layer(s) formed on one side or both sides of a paper member. The release film may have a release layer(s) formed on one side or both sides of a film member. In one embodiment, an elongated releasable substrate wound on a spool may be used, in which forwarding of the releasable substrate can be done by rotating the spool. In some embodiments, an endless releasable substrate may be used.

The viscous waterproof layer used in the first step can exists as a layer on the releasable substrate. In an embodiment, a viscous material, which will be a viscous waterproof layer, is supplied onto the elongated releasable substrate fed from the spool, thereby the viscous waterproof layer being formed on the releasable substrate. In another embodiment, a viscous material, which will be a viscous waterproof layer, is supplied onto the elongated releasable substrate fed from the spool, and during or after this step, curing of the viscous material on the releasable substrate is promoted, thereby the viscous waterproof layer being formed.

In a non-limiting embodiment, the viscous material and the viscous waterproof layer may include at least polyurethane, a dispersant, and a curing agent. In some embodiments, the polyurethane may be a main ingredient, and the dispersant and curing agent may be additives. The polyurethane may be aqueous polyurethane, for example. The curing agent may be an isocyanate compound, for example. The dispersant may be water, for example. The combination of the aqueous polyurethane and the water as a dispersant may realize an eco-friendly manufacturing process. In some embodiments, the viscous material may be material in which crosslinking reaction of polyurethane by the curing agent has not been progressed substantially. The viscous waterproof layer may be a layer in which crosslinking reaction of polyurethane by the curing agent has been slightly progressed. The reaction rate of the crosslinking reaction will increase as the ambient temperature increases higher. A heater may be used in terms of ensuring higher production efficiency, in other words, in order to promote the crosslinking reaction. A general-purpose apparatus that can control its temperature may be sufficient as a heater.

In some embodiments, the aqueous polyurethane is in the form of fine particle, and is provided in the form of a polyurethane emulsion or a polyurethane dispersion, for example. Here, "aqueous" means that water can be used as a dispersion medium. However, the dispersion medium should not necessarily be limited to water.

The aqueous polyurethane used as a main ingredient may be any polyurethane known to those skilled in the art. For example, a polyurethane that can be used may include one or more polyurethanes selected from the group consisting of: polyether-based polyurethanes, polyester-based polyurethanes, polycarbonate-based polyurethanes, and polycaprolactone-based polyurethanes. In some embodiments, a polyurethane having one or more hydrophilic groups may be used. In some embodiments, a polycarbonate-based polyurethane having a hydrophilic group(s) may be suitably used in terms of hydrolysis resistance, heat resistance, oil resistance and abrasion resistance. The hydrophilic group that can be used may include a cationic hydrophilic group, an anionic hydrophilic group, a nonionic hydrophilic group, or any combination of these hydrophilic groups. The cationic group includes an amino group, for example. The anionic hydrophilic group includes a carboxyl group, a phosphonic acid group, and a sulfonic acid group. The nonionic hydrophilic group includes a polyalkylene oxide group (such as a polyethylene oxide group) and a hydroxyl group, for example. Among the hydrophilic groups, a carboxyl group is preferred in terms of reduction of environmental burden. The anionic hydrophilic group such as the carboxyl group may be preferably neutralized with a base such as triethylamine, ammonia, 2-amino-2-methylpropanol or the like, in terms of enhancing hydrophilicity of the polyurethane.

The isocyanate compound used as a curing agent can include aliphatic isocyanates, alicyclic isocyanates, aromatic isocyanates, or any combination thereof. The isocyanate can be selected from dimers, trimers, isocyanate derivatives, isocyanate prepolymers, and blocked isocyanates, for example. The aromatic isocyanates tend to turn yellow. On the other hand, the aliphatic isocyanate, alicyclic isocyanate or any combination thereof has improved discoloration resistance and a long pot life. Therefore, this may ensure a sufficient time for pouring the viscous material into a mold. Examples of the aliphatic isocyanate include ethylene diisocyanate, tetramethylene diisocyanate, hexamethylene diisocyanate, dodecamethylene diisocyanate, 2,2,4-trimethylhexane diisocyanate, lysine diisocyanate, 2,6-diisocyanatomethyl caproate, isophorone diisocyanate, 1,4-cyclohexane diisocyanate, 4,4'-dicyclohexylmethane diisocyanate, bis(isocyanatomethyl)cyclohexane, cyclohexylene diisocyanate, and methylcyclohexylene diisocyanate.

In some embodiments, a solution of isocyanate compound dissolved in a semi-aqueous solvent may be used. The semi-aqueous solvent refers to an organic solvent that is soluble in water. The semi-aqueous solvent includes, for example, a glycol ether-based (diethylene glycol dimethyl ether, propylene glycol monomethyl ether, methoxy dimethyl butanol and the like), alcohol-based (ethanol, isopropanol, and the like), temple-based (d-limonene), and pyrrolidone-based (N-methyl-2-pyrrolidone) solvents. The glycol ether-based solvent in which the hydrocarbon has a hydrophobic nature and the hydroxyl and ether groups have a hydrophilic property has good soluble-compatibility with water contained in the aqueous polyurethane used as the main ingredient. The glycol ether-based solvent may be used in terms of ensuring uniform dispersion of the isocyanate compound.

In some embodiments, an inorganic pigment may be added to the viscous material. This will allow coloration of the waterproof layer into desired color.

In the second step, the viscous waterproof layer on the releasable substrate is attached to the fastener tape base fabric, and the releasable substrate is peeled off the viscous waterproof layer that has been attached to the fastener tape base fabric. As described above with respect to the first step, the viscous waterproof layer exists as a layer on the releasable substrate. The first laminate, in which the viscous waterproof layer is formed on the releasable substrate, is attached onto the fastener tape base fabric, so that the viscous waterproof layer on the releasable substrate is attached to one surface of the fastener tape base fabric. More particularly, an exposed surface of the viscous waterproof layer of the first laminate and one surface of the fastener tape base fabric are attached together. In some embodiments, the first laminate and the fastener tape base fabric are supplied between a pair of rolls, and the viscous waterproof layer of the first laminate is pressured and attached onto the fastener tape base fabric between the pair of rolls. At this moment, a second laminate is formed in which the fastener tape base fabric is laminated on the releasable substrate via the viscous waterproof layer.

In the second step, the releasable substrate is peeled off the viscous waterproof layer that has been attached to the fastener tape base fabric. The peel strength between the viscous waterproof layer and the releasable substrate may be low due to the release layer in the releasable substrate. Compared with this peel strength, the peel strength between the fastener tape base fabric and the viscous waterproof layer may be higher. Based on the difference in the peeling strengths, the releasable substrate can be easily peeled and recovered. In the second step, the releasable substrate is removed from the second laminate to form a third laminate in which the viscous waterproof layer is laminated on the fastener tape base fabric. In some embodiments, the recovered releasable substrate may be recycled, and briefly, fed back to the first step.

In some embodiments, the second step may conduct, completely or substantially simultaneously, the step of attaching the viscous waterproof layer formed on the releasable substrate onto the fastener tape base fabric and the step of peeling the releasable substrate off the viscous waterproof layer that has been attached to the fastener tape base fabric. In some embodiments, after the step of attaching the viscous waterproof layer formed on the releasable substrate to the fastener tape base fabric, the step of peeling the releasable substrate off the viscous waterproof layer that has been attached to the fastener tape base fabric may be carried out.

The fastener tape base fabric may be a fabric woven by the warp and the weft, or knitted by yarns, or a flexible sheet. Examples of the yarns making up the fastener tape base fabric may include polyamide fibers, polyester fibers, acrylic fibers, and the like. By weaving or knitting these synthetic fibers, the fastener tape base fabric can be manufactured.

In the third step, the curing of the viscous waterproof layer formed on the fastener tape base fabric is promoted so that a reduced-viscosity waterproof layer is formed. As stated above, the releasable substrate has been removed in the second step. In some embodiments, an exposed surface of the viscous waterproof layer formed on the fastener tape base fabric is exposed to an elevated temperature atmosphere or a relatively high temperature atmosphere to promote the curing of the viscous waterproof layer. In some embodiments, the crosslinking reaction of the polyurethane due to the isocyanate compound in the viscous waterproof layer may progress, and the moisture in the viscous waterproof layer may be volatilized.

In the fourth step, an exposed surface of the reduced-viscosity waterproof layer formed on the fastener tape base fabric is covered with a releasable cover. In the third step, the curing of the viscous waterproof layer proceeds and the reduced-viscosity waterproof layer is formed. However, a long time may be more often required for sufficiently curing the waterproof layer. In some embodiments, the reduced-viscosity waterproof layer may still have a certain degree of viscosity. In view of this, in the present embodiment, the exposed surface of the waterproof layer formed on the fastener tape base fabric is covered with the releasable cover in the fourth step, thereby avoiding a problem of adhesive characteristics that may remain in the waterproof layer. In the fourth step, the releasable cover is laminated on the exposed surface of the reduced-viscosity waterproof layer formed on the fastener tape base fabric, and the releasable cover is laminated onto the fastener tape base fabric via that waterproof layer to form a fourth laminate.

After ensuring sufficient curing of the waterproof layer formed on the fastener tape base fabric, the releasable cover may be peeled off, thereby providing a fifth laminate in which the waterproof layer is laminated on the fastener tape base fabric. A difference between the third laminate and the fifth laminate is the hardness of the waterproof layer formed on the fastener tape base fabric. The fifth laminate may be referred to as a waterproof fastener tape.

The waterproof fastener tape includes the fastener tape base fabric and the waterproof layer formed on the fastener tape base fabric. The waterproof layer is a single layer consisting of a single composition and includes at least polyurethane cured with a curing agent.

The waterproof layer formed on the fastener tape base fabric is a single layer. Therefore, the thickness of the waterproof fastener tape can be effectively reduced as compared with the conventional tapes. In some embodiments, the reduced thickness of the waterproof fastener tape may improve flexibility of the waterproof fastener tape. In some embodiments, the reduced thickness of the waterproof fastener tape may serve to reduce sliding resistance of a fastener slider when used in a slide fastener. In some embodiments, the reduced thickness of the waterproof fastener tape may reduce a possibility of contact between a flange portion of an upper wing of the fastener slider and the waterproof layer, thereby reducing abrasion of the waterproof layer due to friction. In some embodiments, the reduced thickness of the waterproof fastener tape may reduce the total weight of the slide fastener when used in a slide fastener.

The uppermost limit of thickness of the waterproof layer of the waterproof fastener tape may be 180 μm or 170 μm or 160 μm or 150 μm or 140 μm or 130 μm or 120 μm or 110 μm, for example. Alternatively, the uppermost limit of thickness of the waterproof layer may be 100 μm or 90 μm or 80 μm or 70 μm or 60 μm or 50 μm. The lowermost limit of thickness of the waterproof layer of the waterproof fastener tape may be 35 μm or 40 μm or 45 μm or 50 μm, for example. Those skilled in the art may appreciate that the thickness of the waterproof layer of the waterproof fastener tape may vary depending on the thickness and composition of the viscous waterproof layer in the first step.

In some embodiments, the fastener tape base fabric processed in the first to fourth steps has been provided with a fastener element. For example, the fastener tape base fabric has a pair of main surfaces, a coil element is sewn onto one main surface, and the coil element is not sewn onto the other main surface. The waterproof layer and the releasable cover are laminated in this order from the other main surface of the fastener tape base fabric through the first to fourth steps.

In some embodiments, the fastener tape base fabric to be processed in the first to fourth steps has not been provided with the fastener elements, and after the waterproof fastener tape is manufactured, the waterproof fastener tape is provided with the fastener elements. For example, the side edge portion of the waterproof fastener tape is provided with resin elements by insert molding.

Figure 2:
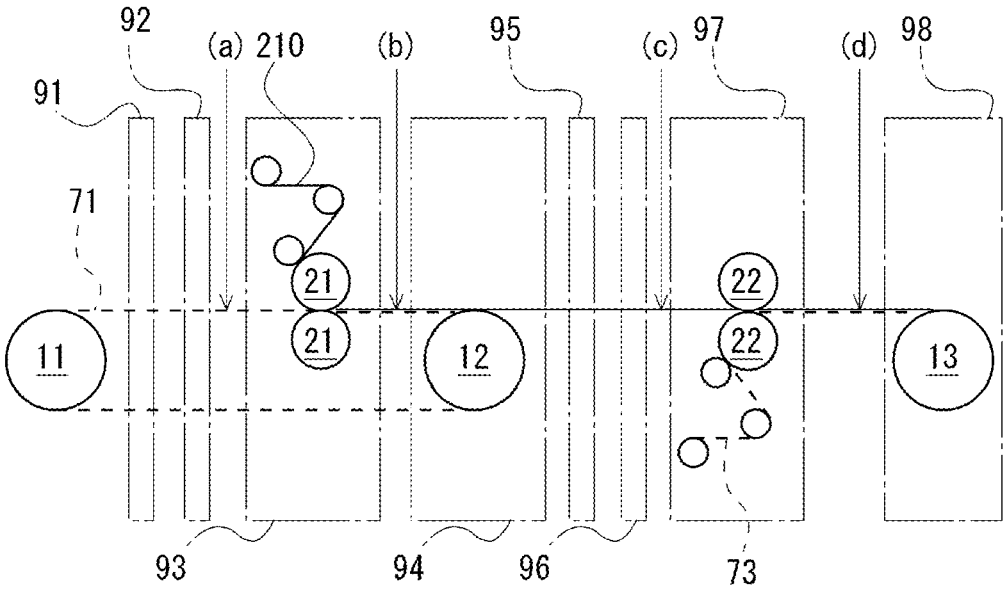
FIG. 2 is a schematic view showing steps for manufacturing a waterproof fastener tape according to an embodiment of the present invention.
Figure 3:
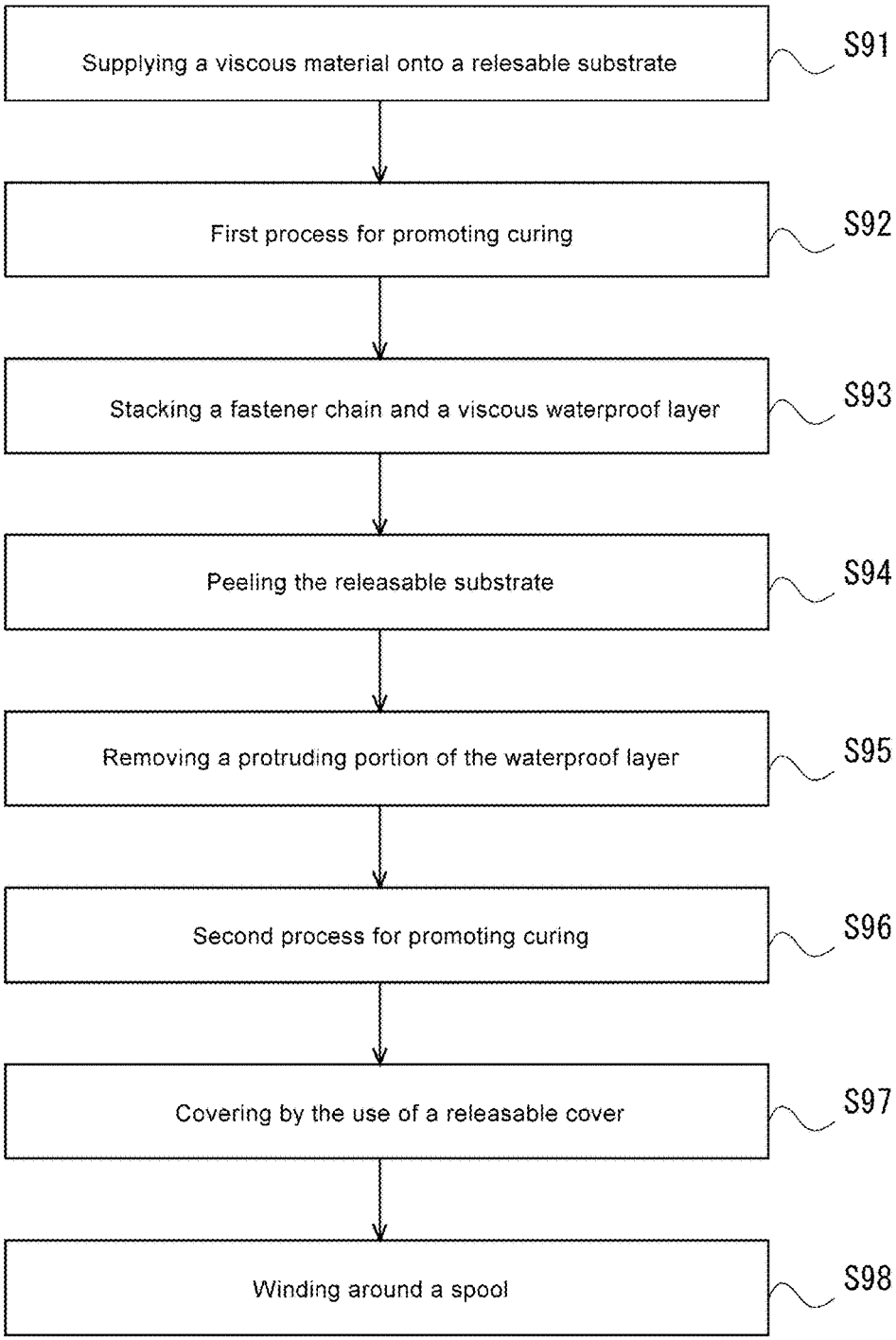
FIG. 3 is a flow chart showing steps for manufacturing a waterproof fastener tape according to an embodiment of the present invention.
Figure 4:
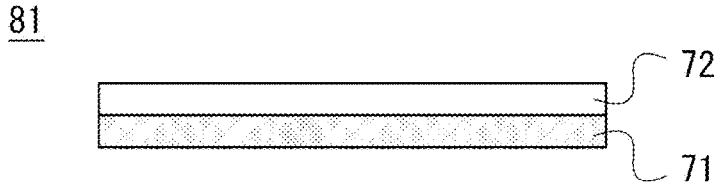
FIGS. 4(*a*), 4(*b*), 4(*c*), and 4(*d*) are collectively referred to as FIG. 4.
Figure 4:
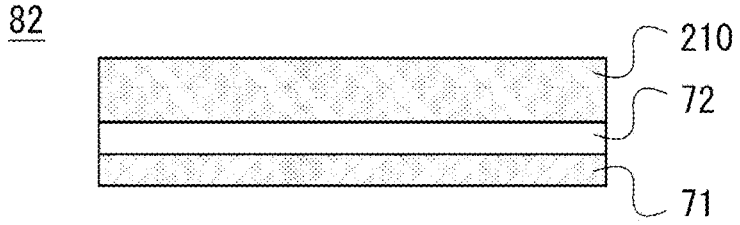
Figure 4:
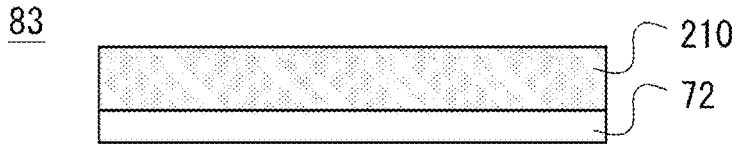
Figure 4:
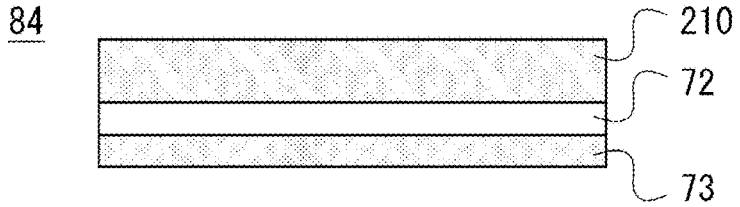
Figure 5A:
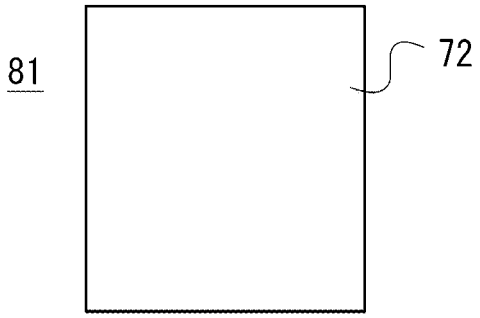
FIGS. 5(*a*), 5(*b*), 5(*c*), and 5(*d*) are collectively referred to as FIG. 5.
Figure 5B:
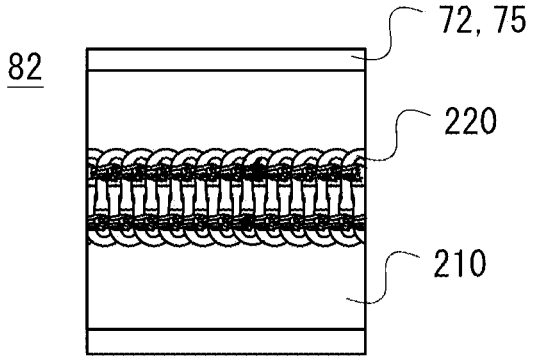
Figure 5C:
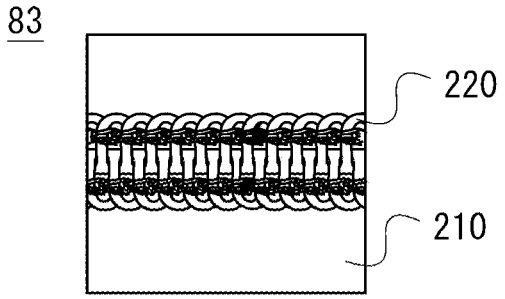
Figure 5D:
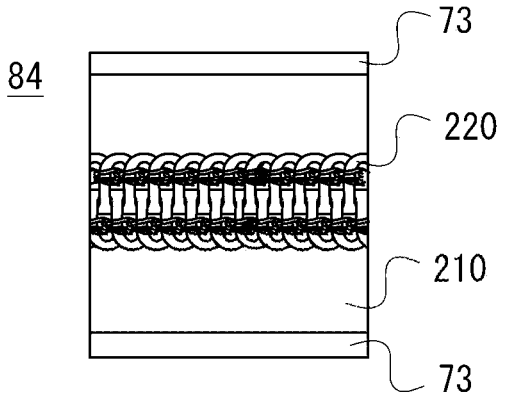
Figure 6:
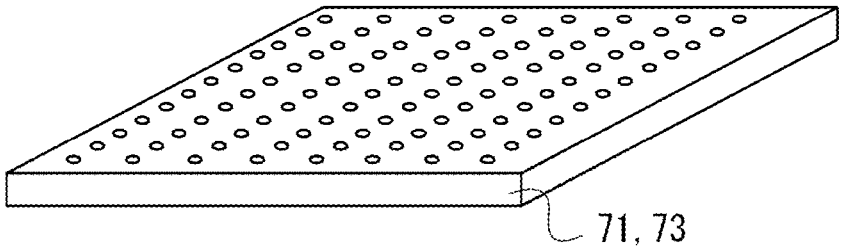
FIG. 6 is a schematic perspective view of a releasable substrate and a releasable cover used in the steps for manufacturing a waterproof fastener tape according to an embodiment of the present invention.
Figure 7:
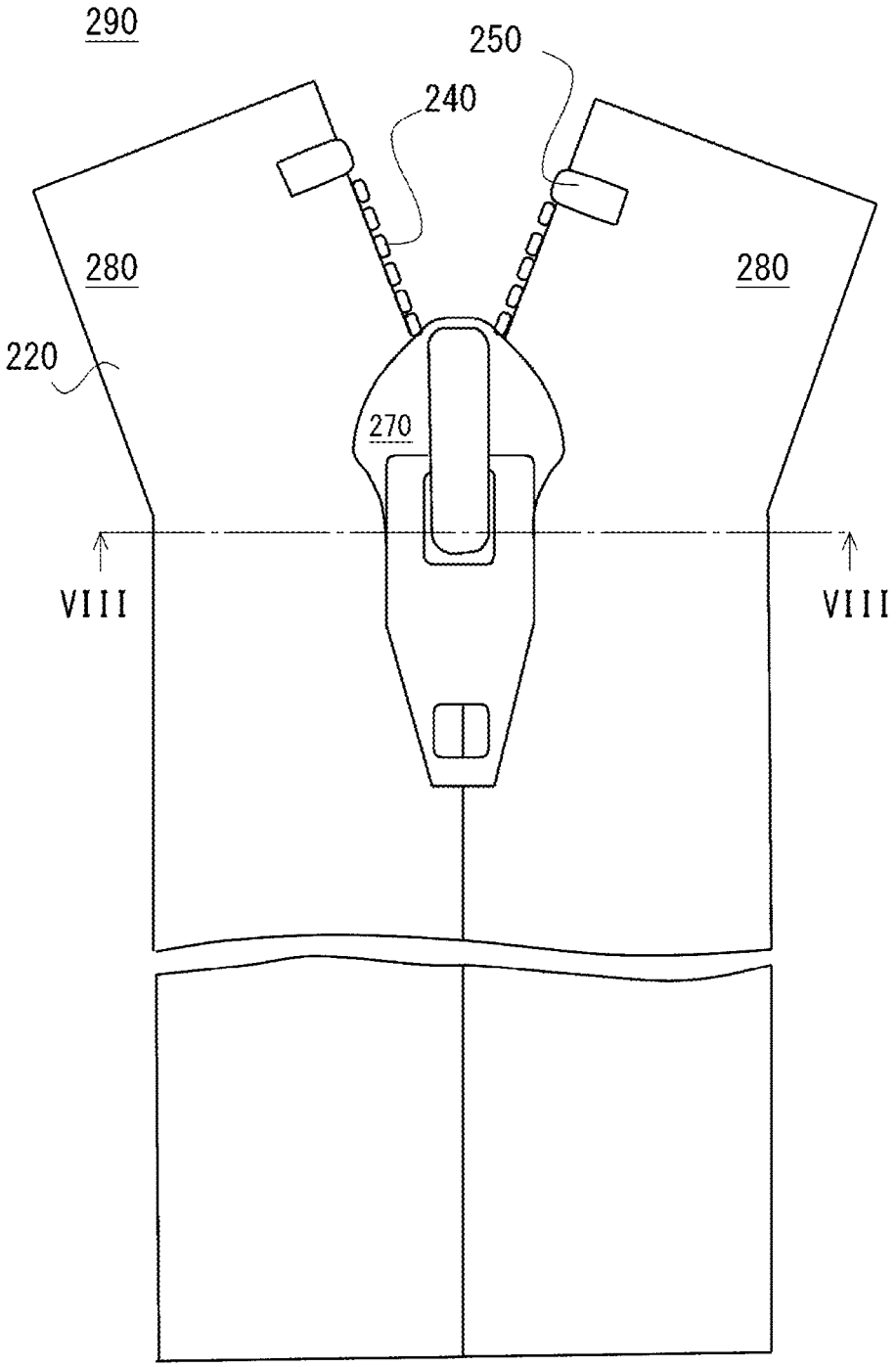
FIG. 7 is a schematic plan view of a waterproof slide fastener according to an embodiment of the present invention.
Figure 8:
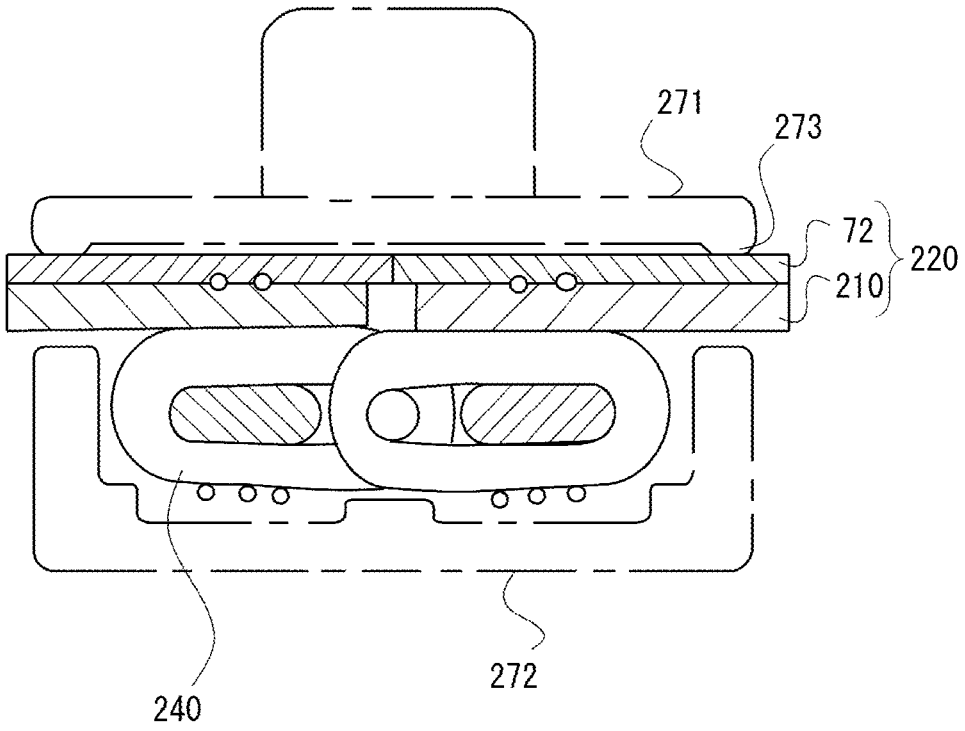
FIG. 8 is a schematic cross-sectional view of a waterproof slide fastener according to an embodiment of the present invention, showing a schematic sectional configuration taken along VIII-VIII of FIG. 7.

Details of an exemplary embodiment will be discussed hereinafter with reference to FIGS. 2 to 8. FIG. 2 is a schematic view showing steps for manufacturing a waterproof fastener tape according to an embodiment of the present invention. FIG. 3 is a flow chart showing steps for manufacturing the waterproof fastener tape according to an embodiment of the present invention. FIG. 4 is a schematic view showing laminated structures of laminates which appear during steps for manufacturing a waterproof fastener tape according to an embodiment of the present invention. FIG. 5 is a schematic view showing one surfaces of laminates which appear during steps for manufacturing a waterproof fastener tape according to an embodiment of the present invention. FIG. 6 is a schematic perspective view of the releasable substrate and the releasable cover used in the steps for manufacturing the waterproof fastener tape according to an embodiment of the present invention. FIG. 7 is a schematic plan view of the waterproof slide fastener according to an embodiment of the present invention. FIG. 8 is a schematic cross-sectional view of a waterproof slide fastener according to an embodiment of the present invention, showing a schematic sectional configuration taken along VIII-VIII of FIG. 7.

As can be seen from FIG. 2, a releasable substrate 71 is wound endlessly on a supply spool (or a first spool) 11 and a take-up spool (or a second spool) 12. By way of an example, one spool of the supply spool 11 and the take-up spool 12 rotates in response to rotational force transmitted from a motor, and the other spool passively rotates in response to force transmitted via the releasable substrate 71. The releasable substrate 71 forwarded from the supply spool 11 passes through a viscous material supplying unit 91 and a first heater 92. The viscous material supplying unit 91 supplies a viscous material onto the releasable substrate 71. For example, the viscous material supplying unit 91 has a frame body disposed above the releasable substrate 71, and supplies the viscous material into the frame body. The releasable substrate 71 is forwarded so as to close the frame body at its bottom. A new specific region of the releasable substrate 71 passes through below the frame body, thereby a layer of the viscous material is formed onto the specific region of the releasable substrate 71. Any known method may be used for ensuring a constant layer thickness as much as possible.

To ensure an appropriate thickness of the viscous material, the composition of the viscous material may be adjusted. In some embodiments, a thickener may be added additionally to the polyurethane, water and the isocyanate compound as suggested above. The thickener that may be used may include any water-soluble thickener known in the art. Examples of the thickener include natural polymers such as polysaccharides and gelatin; synthetic polymers such as polyoxyethylene and cross-linked poly(meth)acrylic acid; and inorganic minerals such as montmorillonite and silica.

In some embodiments, a silicone compound is added to the viscous material, thereby enhancing abrasion resistance of the waterproof layer of the waterproof fastener tape. In some embodiments, the silicone compound is contained in an amount of 2% by mass or more or 4% by mass or more in the waterproof layer of the waterproof fastener tape (solid content basis). An excessive high content of the silicone compound may result in a brittle waterproof layer of the waterproof fastener tape. Therefore, the silicone compound may preferably be contained in an amount of 25% by mass or less, and more preferably 15% by mass or less, in the waterproof layer of the waterproof fastener tape. At least a part of the silicone compound is present in the form of a copolymer with the polyurethane making up the waterproof layer of the waterproof fastener tape.

The viscous material layer formed on the releasable substrate 71 passes through the first heater 92, and in this process, the curing of the polyurethane in the viscous material is promoted to form the viscous waterproof layer 72. In some embodiments, a viscous material having a suitable composition and fluidity may be used, and the first heater 92 may be omitted. In this case, the viscous waterproof layer 72 is formed on the releasable substrate 71 after the releasable substrate 71 has passed through the viscous material supplying unit 91. A temperature of the first heater 92 may be 60° C. to 120° C., for example. A forwarding speed of the releasable substrate 71 may be 0.5 m/min to 3.0 m/min, for example. A time period required for passing through the first heater 92 may be 1 minute to 5 minutes, for example.

A laminated structure of a first laminate 81 in which the viscous waterproof layer 72 is laminated onto the releasable substrate 71 is shown in FIG. 4(*a*), and a partial plan view of the main surface of the laminated structure of the first laminate 81 is shown in FIG. 5(*a*). It should be noted that each layer shown in FIG. 4 is not intended to reflect any actual thickness, and the same holds true for the following descriptions.

The first laminate 81 in which the viscous waterproof layer 72 is laminated onto the releasable substrate 71 is supplied to a first press unit 93. The fastener tape base fabric 210 is also supplied to the first press unit 93 by an illustrated roll transfer mechanism. The first press unit 93 has a pair of rolls 21, and the first laminate 81 and the fastener tape base fabric 210 are pressed and stacked together between the pair of rolls 21. The viscous waterproof layer 72 of the first laminate 81 adheres to one surface of the fastener tape base fabric 210. A second laminate 82 is formed in which the fastener tape base fabric 210 is laminated onto the releasable substrate 71 via the viscous waterproof layer 72.

The laminated structure of the second laminate 82 is shown in FIG. 4(*b*), and a partial plan view of the main surface of the laminated structure of the second laminate 82 is shown in FIG. 5(*b*).

As can be seen from FIG. 5(*b*), a fastener chain including the fastener tape base fabrics 210 may be supplied to the first press unit 93. Even in this manner, there is no deviation from the fact that the fastener tape base fabric 210 is supplied to the first press unit 93. Higher production efficiency may be ensured by collectively forming the waterproof layer on the fastener chain, rather than by individually forming the waterproof layers on the right and left fastener stringers. Furthermore, when forming the waterproof layer on the fastener chain, the opposite end portions of the left and right waterproof layers are suitably matched when the right and left fastener stringers are closed, thereby ensuring an improved waterproof property. In addition, after forming the waterproof layer on the fastener chain, the waterproof layer may be cut along an engaging line of the right and left fastener element rows.

As will be understood by comparison of FIG. 5 (*a*) with FIG. 5(*b*) or by FIG. 5(*b*) itself, the width of the releasable substrate 71 orthogonal to the transfer direction is wider than the width of the fastener chain orthogonal to the transfer direction. Thus, the viscous waterproof layer 72 can be thoroughly attached to one surface of the fastener chain.

As shown in FIG. 2, the second laminate 82 in which the fastener tape base fabric 210 is laminated onto the releasable substrate 71 via the viscous waterproof layer 72 may be supplied to a releasable substrate take-up unit 94. The illustrated exemplary releasable substrate take-up unit 94 has a take-up spool 12 for reeling the releasable substrate 71 around which the releasable substrate 71 is wound based on rotation of the take-up spool 12. Thus, a third laminate 83 is formed in which the viscous waterproof layer 72 is laminated onto the fastener tape base fabric 210. In other words, the viscous waterproof layer 72 that is a single layer remains on the fastener tape base fabric 210, and transition of the viscous waterproof layer 72 from the releasable substrate 71 to the fastener tape base fabric 210 is finished. By way of an example, an endless releasable substrate 71 may be wound around the supply spool 11 and the take-up spool 12, and the rotational speeds of the respective spools may be equal one another.

FIG. 4(*c*) shows the laminated structure of the third laminate 83 in which the viscous waterproof layer 72 is laminated on the fastener tape base fabric 210.

As shown in FIG. 2, the third laminate 83 is forwarded to a second heater 95. By passing through the second heater 95, curing of the viscous waterproof layer 72 is promoted, the viscosity is reduced, and the waterproof layer 72 having reduced viscosity is formed on the fastener tape base fabric 210. As an exemplary difference of the waterproof layer 72 prior to and posterior to the second heater 95, a difference in the degree of curing of the polyurethane, a difference in the degree of evaporation of water in the waterproof layer 72, and a difference in the mass/weight of the waterproof layer 72 itself may be suggested.

The exposed surface of the viscous waterproof layer 72 formed on the fastener tape base fabric 210 is exposed to an elevated temperature or a relatively higher temperature atmosphere in the second heater 95, so that the curing of the viscous waterproof layer is promoted. For example, the crosslinking reaction of the polyurethane due to the isocyanate compound in the viscous waterproof layer may progress, and the moisture in the viscous waterproof layer may be volatilized.

A temperature of the second heater 95 may be 60° C. to 120° C., for example. A transfer rate may be 0.5 m/min to 3.0 m/min, for example. A time period required for passing through the second heater 95 may be 1 minute to 5 minutes, for example.

The third laminate 83 that has passed through the second heater 95 may be supplied to a cutting device 96. The cutting device 96 removes protruding portions of the waterproof layer 72, which protrude outwardly from the fastener chain and the fastener tape base fabric 210 in the width direction orthogonal to the transfer direction. Accordingly, the protruding portions of the waterproof layer 72 are removed which were present and protruded outwardly in the width direction from the fastener chain in FIG. 5(*b*), thereby a fastener chain being obtained in which the unnecessary portions of the waterproof layer 72 as shown in FIG. 5 (*b*) have been removed.

The third laminate 83 that has passed through the cutting device 96 may be supplied to a second press unit 97. The second press unit 97 stacks the third laminate 83 and the releasable cover 73 together so as to cover an exposed surface of the waterproof layer 72 of the third laminate 83 by the releasable cover 73. The releasable cover 73 is laminated onto the exposed surface of the reduced-viscosity waterproof layer 72 to form a fourth laminate 84 in which the releasable cover 73 is laminated onto the fastener tape base fabric 210 via that waterproof layer 72.

FIG. 4(*d*) shows the laminated structure of the fourth laminate 84 in which the releasable cover 73 is laminated onto the fastener tape base fabric 210 via the waterproof layer 72, and FIG. 5(*d*) shows a partial plan view of the main surface on the laminated structure of the fourth laminate 84. As shown in FIG. 5 (*d*), in the width direction orthogonal to the transfer direction, the lateral width of the releasable cover 73 is wider than the lateral width of the fastener tape base fabric 210 and the lateral width of the fastener chain. Thus, the problem of adhesive characteristics of the waterproof layer 72 may be resolved with higher certainty.

In an example shown in FIG. 2, the second press unit 97 has a pair of rolls 22, and the third laminate 83 and the releasable cover 73 are supplied between the pair of rolls 22, and pressed and stacked together therebetween, so that the fourth laminate 84 is formed. The waterproof layer 72 in the third laminate 83 is protected by the releasable cover 73. In some embodiments, the waterproof layer 72 in the third laminate 83 is attached to the releasable cover 73. In some embodiments, the waterproof layer 72 may remain tacky, even after passing through the second heater 95. The covering of the exposed surface of the waterproof layer 72 by the releasable cover 73 may solve the problem of adhesive characteristics. It should be noted that the releasable cover 73 may be the same as or different from the releasable substrate 71. The releasable cover 73 may be supplied between a pair of rolls 22 by means of a transfer mechanism including a plurality of rolls.

The fourth laminate 84 that has passed through the second press unit 97 may be supplied to a take-up unit 98. The take-up unit 98 has a spool 13 for reeling the fourth laminate 84 in which the releasable cover 73 is laminated onto the fastener tape base fabric 210 via the waterproof layer 72. The elongated fourth laminate 84 may be wound around the spool 13 so that storing of the fourth laminate 84 will be simplified. Furthermore, by supplying the spool 13 to a heater (not shown), the curing of the waterproof layer 72 of the fourth laminate 84 may be further promoted.

Although not shown in FIG. 2, after the curing of the waterproof layer 72 has progressed sufficiently, the releasable cover 73 may be peeled off so that a fifth laminate is obtained in which a sufficiently-cured waterproof layer 72 is laminated on the fastener tape base fabric 210.

FIG. 3 is a schematic flow chart of the steps described above, schematically illustrating the respective operations of the viscous material supplying unit 91, the first heater 92, the first press unit 93, the releasable substrate take-up unit 94, the second heater 95, the cutting device 96, the second press unit 97, and the take-up unit 98.

According to the manufacturing methods described above, it may be possible to avoid a problem derived from the viscosity of the waterproof layer, while achieving thinning of the waterproof layer. Furthermore, it may be possible to highly control a surface state of an exposed surface of the waterproof layer by using the releasable substrate and the releasable cover. This could be an outstanding technical effect which is far beyond a case in which a fastener tape base fabric is coated by a waterproof layer material in order to form a waterproof layer of a single layer. For example, the waterproof layer of a thin layer may result in: i) increased flexibility of the fastener tape; ii) reduced sliding resistance of a fastener slider being facilitated when used in a slide fastener; iii) reduced abrasion of the waterproof layer due to friction as a possibility of contact between a flange portion of an upper wing of a fastener slider and the waterproof layer is reduced; and iv) reduced weight of the slide fastener when used in a slide fastener.

As shown in FIG. 6, a pattern of projections, a pattern of recesses, or the combination of the projection and concave patterns may be provided on one or both of the main surfaces of the releasable substrate 71 and the releasable cover 73. Specific front view shape of the projection and the recess should be arbitrary, e.g., circular, triangular, square, pentagonal, linear, S-shaped, and the star-shaped, etc., and may represent a character or a picture in some embodiments. It could be illustrated as that the main surface of the releasable substrate 71 or a releasable cover 73 is formed as a non-planar surface. In this case, a design formed on the main surface of the releasable substrate 71 can be transferred to the viscous waterproof layer 72. Similarly, a design formed on the main surface of the releasable cover 73 can be transferred to the reduced-viscosity waterproof layer 72.

A waterproof layer 72 with a transferred design may be thus formed, and may present a quite delicate appearance in some embodiments. When the releasable substrate or the releasable cover is used, a skilled person would appreciate that an exposed surface of the waterproof layer 72 having a highly controlled surface state may be achieved compared to other film-formation methods.

If both of the main surfaces of the releasable substrate and the releasable cover are a flat surface, the exposed surface of the waterproof layer 72 finally obtained can gain a high gloss. Also, this feature would not be easily achieved by a film-formation methods in which the releasable substrate nor the releasable cover are not utilized.

In some embodiments, a design to be transferred to a surface of the viscous waterproof layer 72 may be formed on a surface of the releasable substance at the side to be in contact with the viscous waterproof layer 72. Alternatively or additionally, in some embodiments, a design to be transferred to a surface of the (reduced-viscosity) waterproof layer 72 may be formed on a surface of the releasable cover 73 at the side to be in contact with the (reduced-viscosity) waterproof layer 72.

When the viscous waterproof layer 72 is cured, vaporization of the dispersant in the viscous waterproof layer 72 and the crosslinking reaction of the polyurethane with an isocyanate compound in the viscous waterproof layer 72 are caused, and crosslinked polyurethane is formed in the layer as such crosslinking reaction proceeds. After the crosslinking reaction has progressed completely or sufficiently, solid content of the crosslinked polyurethane and thickeners may be mainly included in the (reduced-viscosity) waterproof layer 72.

An example of a slide fastener which can be manufactured using the above-described fastener tape or fastener chain will be described with reference to FIGS. 7 and 8. As shown in FIG. 7, a slide fastener 290 includes a pair of right and left fastener stringers 280, and one fastener slider 270 for opening and closing the pair of right and left fastener stringers 280. The fastener stringer 280 is an article in which a fastener element 240 is provided on the opposed side edge of the fastener tape 220. Respective fastener elements 240 of the right and left fastener stringers 280 may be coupled as a fastener slider 270 moves forward, thereby closing the right and left fastener stringers 280. The respective fastener elements 240 of the right and left fastener stringers 280 may be decoupled as the fastener slider 270 moves rearward, thereby opening the right and left fastener stringers 280.

The fastener tape 220 may be an article in which the (reduced-viscosity) waterproof layer 72 of a single layer is laminated on an upper surface of the fastener tape base fabric 210. In the illustrated example, the coil element is sewn onto a lower surface of the fastener tape base fabric 210. The coil element is not provided on the upper surface of the fastener tape base fabric 210, and thus one surface of the fastener tape base fabric 210 can preferably be attached to the viscous waterproof layer 72 as described above.

Fastener slider 270 may be a metal or plastic part having an upper wing 271 and lower wing 272 which are coupled by a coupling pillar. The flange portion 273 provided at the right and left side edges of the upper wing 271 may come into contact with the exposed surface of the waterproof layer 72 during the frontward and rearward movement of the fastener slider 270. In the present embodiment, the thickness of the waterproof layer 72 can be reduced. Thus, the abrasion of the waterproof layer 72 may be reduced in some embodiments.

Figure 9:
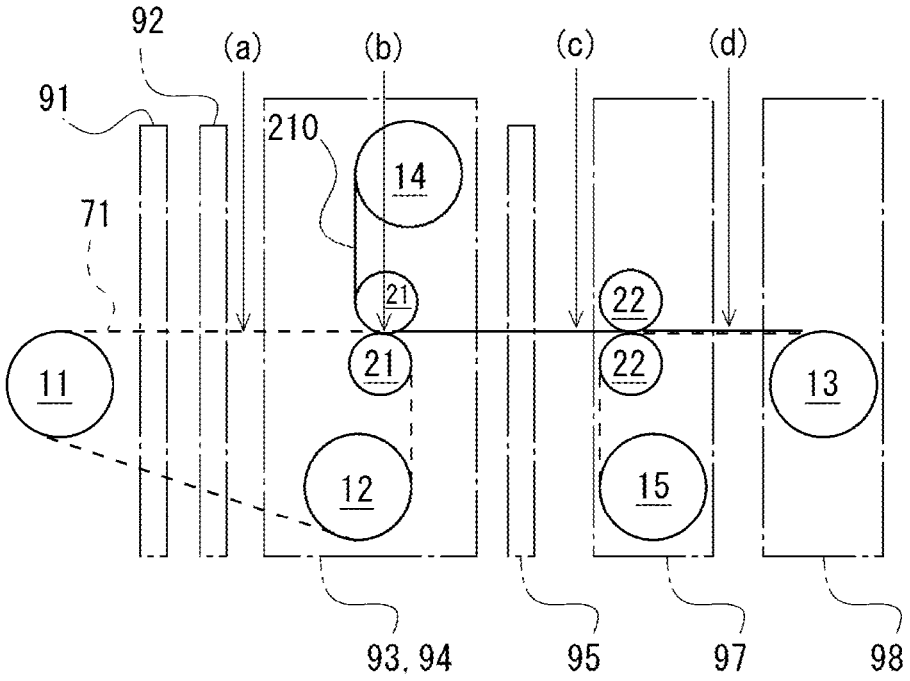
FIG. 9 is a schematic view showing steps for manufacturing a waterproof fastener tape according to another embodiment of the present invention.

In another manufacturing method shown in FIG. 9, unlike the embodiments described above, stacking and pressing of the fastener tape base fabric 210 against the first laminate 81 and peeling of the releasable substrate 71 off the second laminate 82 are performed substantially simultaneously. Even in such case, the same effect as above-described embodiments may be achieved.

As shown in FIG. 9, the viscous material supplying unit 91, the first heater 92, the first press unit 93, the releasable substrate take-up unit 94, the second heater 95, the second press unit 97, and the take-up unit 98 are provided. The releasable substrate 71, which may be supplied from a pair of rolls of the first press unit 93, is being taken up by the take-up spool 12. In the case shown in FIG. 9, unlike the embodiment described above, the cutting device 96 is omitted. Such embodiment is also envisioned. The fastener chain may be wound around the spool 14, and may be supplied to the roll 21. The releasable cover 73 may be wound around the spool 15, and may be supplied to the roll 22.

Figure 10:
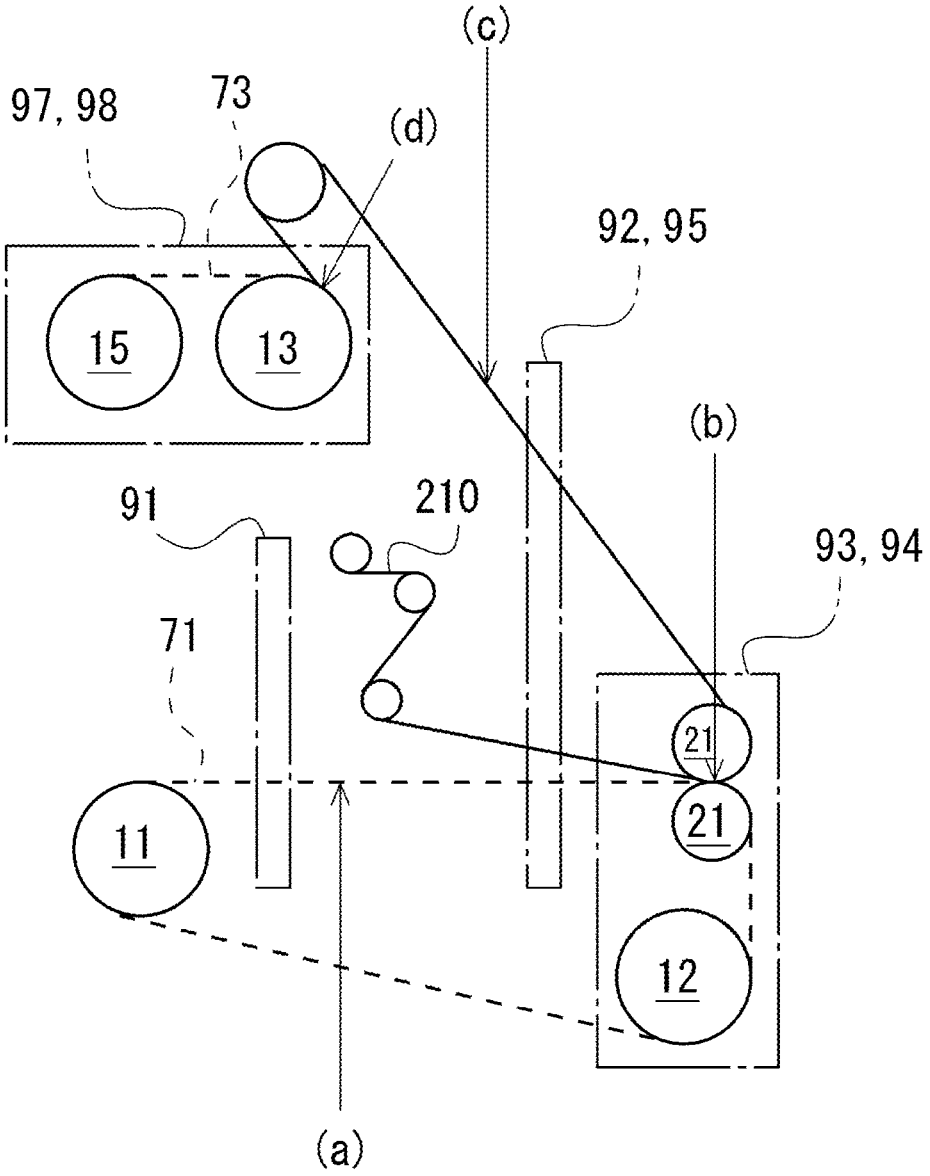
FIG. 10 is a schematic view showing steps for manufacturing a waterproof fastener tape according to still another embodiment of the present invention.

In another manufacturing method shown in FIG. 10, unlike the embodiment shown in FIG. 9, the first heater 92 and second heater 95 are shared. A timing when the releasable cover 73 is taken up by the spool 13 together with the third laminate 83 so that the fourth laminate 84 is formed as the releasable cover 73 covers the waterproof layer 72 and a timing when the fourth laminate 84 is wound around the spool 13 may be perfectly or substantially identical. The same effects as the examples shown in FIGS. 2 and 9 would be obtained in such embodiments.

Given the above teachings, a skilled person in the art would be able to add various modifications to the embodiments. Reference codes included in claims are just for reference and should not be referenced for purposes of narrowly construing the scope of claims.

REFERENCE SIGNS LIST

71 Releasable substrate
72 Viscosity waterproof layer
73 Releasable cover member
81-84 Laminates
210 Fastener tape base fabric

The invention claimed is:

1. A method for manufacturing a waterproof fastener tape, the method comprising:

forming a viscous waterproof layer on a releasable substrate;

attaching the viscous waterproof layer formed on the releasable substrate to a fastener tape base fabric, and peeling the releasable substrate off the viscous waterproof layer that has been attached to the fastener tape base fabric;

promoting curing of the viscous waterproof layer formed on the fastener tape base fabric to form a reduced-viscosity waterproof layer; and after said promoting of curing of the viscous waterproof layer, covering an exposed surface of the reduced-viscosity waterproof layer formed on the fastener tape base fabric with a releasable cover.

2. The method for manufacturing a waterproof fastener tape according to claim 1, further comprising:

winding around a spool a laminate in which the reduced-viscosity waterproof layer and the releasable cover are laminated in this order from the fastener tape base fabric.

3. The method for manufacturing a waterproof fastener tape according to claim 1, wherein a pattern to be transferred to a surface of the viscous waterproof layer is formed on a surface of the releasable substrate at a side to be in contact with the viscous waterproof layer.

4. The method for manufacturing a waterproof fastener tape according to claim 1, wherein a pattern to be transferred to an exposed surface of the reduced-viscosity waterproof layer is formed on a surface of the releasable cover at a side to be in contact with the reduced-viscosity waterproof layer.

5. The method for manufacturing a waterproof fastener tape according to claim 1, wherein the viscous waterproof layer includes at least polyurethane, a dispersant, and a curing agent.

6. The method for manufacturing a waterproof fastener tape according to claim 1, wherein the reduced-viscosity waterproof layer includes at least polyurethane cured with a curing agent.

7. The method for manufacturing a waterproof fastener tape according to claim 1, wherein said promoting of curing of the viscous waterproof layer includes supplying, to a heater, the fastener tape base fabric provided with the viscous waterproof layer.

8. The method for manufacturing a waterproof fastener tape according to claim 1, further comprising:

removing a protruding portion of the viscous waterproof layer which protrudes from the fastener tape base fabric.

* * * * *